US005550553A

United States Patent [19]

Yamaki et al.

[11] Patent Number: 5,550,553

[45] Date of Patent: Aug. 27, 1996

[54] DIELECTRIC ROD ANTENNA

[75] Inventors: Kazuhisa Yamaki; Kazunari Kawabata, both of Nagaokakyo, Japan

[73] Assignee: Murata Manufacturing Co., Ltd., Japan

[21] Appl. No.: 198,152

[22] Filed: Feb. 17, 1994

[30] Foreign Application Priority Data

Feb. 18, 1993 [JP] Japan ..... 5-028754

[51] Int. Cl.[6] ..... H01Q 13/00

[52] U.S. Cl. ..... 343/785; 343/756; 343/786; 333/24.3

[58] Field of Search ..... 343/777, 756, 343/785, 786, 840; 333/24.3, 21 A; H01Q 13/00

[56] References Cited

U.S. PATENT DOCUMENTS

| | | | |
|---|---|---|---|
| 2,857,574 | 10/1958 | Anderson | 333/24.3 X |
| 2,981,945 | 4/1961 | Fyler et al. | 343/753 |
| 3,038,131 | 6/1962 | Uebele et al. | 333/24.3 X |
| 3,128,467 | 4/1964 | Lanctot | 343/708 |
| 3,154,784 | 10/1964 | Allen | 343/18 |
| 3,241,145 | 3/1966 | Petrides | 343/785 X |
| 3,518,691 | 6/1970 | Hallendorff | 343/785 |
| 3,765,021 | 10/1973 | Chiron et al. | 343/785 |
| 4,188,632 | 2/1980 | Knox | 343/753 |
| 4,544,900 | 10/1985 | Howard | 343/786 X |
| 4,554,553 | 11/1985 | Grim | 343/786 |
| 4,910,527 | 3/1990 | Dushane et al. | 343/786 |
| 5,128,637 | 7/1992 | Nisbet et al. | 343/786 X |
| 5,172,081 | 12/1992 | Gabriel et al. | 343/756 X |
| 5,260,713 | 11/1993 | Mutson | 343/756 |

FOREIGN PATENT DOCUMENTS

| | | | |
|---|---|---|---|
| 63996 | 10/1955 | France . | |
| 1177180 | 4/1959 | France . | |
| 2648375 | 4/1978 | Germany | 343/785 |
| 0009349 | 1/1977 | Japan | 343/785 |
| 0185901 | 8/1991 | Japan | 333/24.3 |
| 0750062 | 6/1956 | United Kingdom | 343/756 |

*Primary Examiner*—Rolf Hille
*Assistant Examiner*—Steven Wigmore
*Attorney, Agent, or Firm*—Ostrolenk, Faber, Gerb & Soffen, LLP

[57] ABSTRACT

A dielectric rod antenna including a dielectric rod, a ring-shaped conductive film provided on an outer peripheral surface of the dielectric rod, and a waveguide. The conductive film is provided on an outer peripheral surface portion of the dielectric rod which is inclined from a base end portion toward a forward end portion. The conductive film is arranged to intersect the waveguide so as to form a substantially V-shaped cross-sectional area.

8 Claims, 4 Drawing Sheets

DIELECTRIC ROD ANTENNA

BACKGROUND OF THE INVENTION

1. Field of the Invention

The present invention relates to a dielectric rod antenna, which is employed for satellite broadcasting, INMARSAT communication or the like.

2. Description of the Background Art

When a conventional dielectric rod antenna is employed as a primary radiator for a parabolic reflector antenna, gain is disadvantageously caused difference between E-plane radiation pattern and H-plane radiation pattern as received if either one of the dual polarized electromagnetic wave is horizontally polarized and the other one is vertically polarized (this wave is hereinafter referred to as cross-polarized wave), since E-plane radiation pattern and H-plane radiation pattern of the rod antenna have different patterns. When the conventional dielectric rod antenna receives a circularly polarized electromagnetic wave, on the other hand, polarization loss is increased due to the difference in directivity between the E-plane and H-plane radiation patterns. In addition, the antenna efficiency is deteriorated if the antenna has large side lobes.

SUMMARY OF THE INVENTION

Accordingly, an object of the preferred embodiments of the present invention is to provide a dielectric rod antenna which is provided with E-plane radiation pattern and H-plane radiation pattern having substantially equal directional patterns, and small side lobes.

According to a feature of the preferred embodiments of the present invention, a dielectric rod antenna comprises:

(a) a dielectric rod;

(b) a conductor which is provided on an outer peripheral surface of the dielectric rod substantially in the form of a ring; and (c) a conductor housing for supporting the dielectric rod.

According to another feature of the preferred embodiments of the present invention, the conductor is provided on an outer peripheral surface of the dielectric rod substantially in the form of a ring, thereby uniformly suppressing spreading of an electromagnetic wave which is propagated through the interior of the dielectric rod and substantially equalizing the directional patterns of the magnetic and electric field planes with each other.

According to another aspect of the preferred embodiments of the present invention, the dielectric rod antenna further comprises a long ferrite member having an end which is embedded in a base end portion of the dielectric rod and another end which is projected so that its axial direction is in parallel with that of the dielectric rod, and means for generating a direct magnetic field in parallel with the axial direction of the ferrite member.

According to another aspect of the preferred embodiments of the present invention, the dielectric rod antenna further comprises a flat plate type polarization converter which is provided in series with the base end of the dielectric rod so that its major surface is in parallel with the longitudinal direction of the dielectric rod.

According to the preferred embodiments of the present invention, it is possible to obtain a dielectric rod antenna which is provided with magnetic and electric field radiation patterns having substantially equal directional patterns, due to the conductor provided on the outer peripheral surface of the dielectric rod between the dielectric rod and a waveguide conductor housing such that the conductor and the conductor housing intersect to form a V-shaped cross-sectional area. When this dielectric rod antenna is employed as a primary radiator for a parabolic reflector antenna, it is possible to obtain a highly efficient parabolic reflector antenna. Further, the side lobes can be reduced, while it is possible to easily obtain directivity which is required for an antenna using communication satellite since a cross-polarized wave can also be received with no gain difference.

In addition, it is possible to obtain a dielectric rod antenna provided with a polarization converter by mounting a long ferrite member so that an end thereof is embedded in the base end portion of the dielectric rod and/or coupling a flat plate type polarization converter to the base end portion.

The foregoing and other objects, features, aspects and advantages of the preferred embodiments of the present invention will become more apparent from the following detailed description of embodiments of the present invention when taken in conjunction with the accompanying drawings.

DESCRIPTION OF PREFERRED EMBODIMENTS

Figure 1:
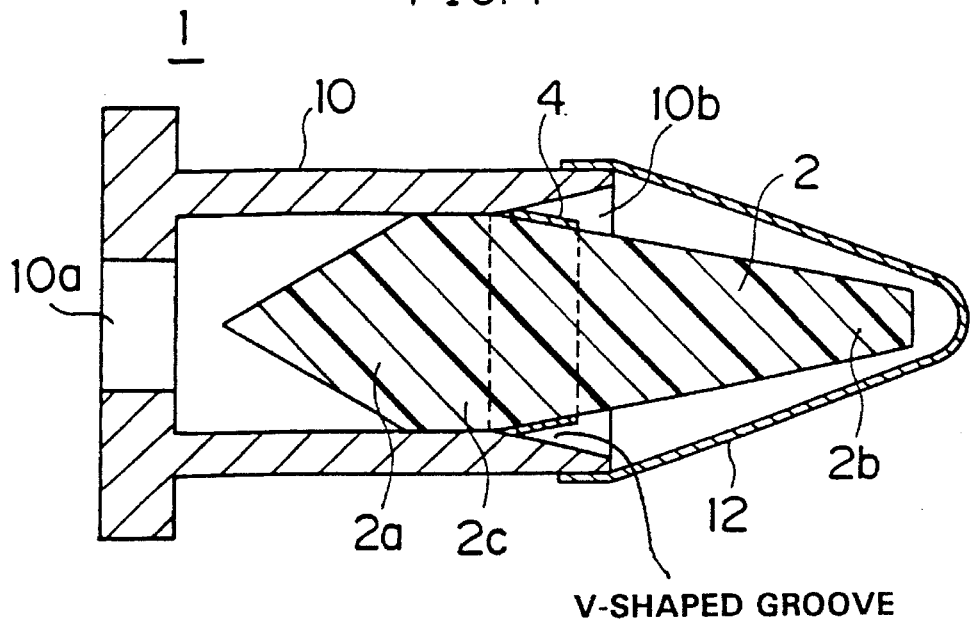
FIG. 1 is a sectional view showing a dielectric rod antenna according to a first preferred embodiment of the present invention.

Preferred embodiments of the inventive dielectric rod antenna are now described with reference to the drawings. In the following description of the preferred embodiments, identical components and parts are denoted by the same reference numerals.

As shown in FIG. 1, a dielectric rod antenna 1 according to a first preferred embodiment of the present invention is formed by a dielectric rod 2, a waveguide 10 and a radome 12. The dielectric rod 2, which has a circular cross section, is made of a dielectric material such as resin or ceramics.

A base end portion 2a of the dielectric rod 2 has an end which is in the form of a conical protrusion, to be capable of converting a propagation mode ($HE_{11}$ mode) in the dielectric rod 2 to a propagation mode ($TE_{11}$ mode) in the waveguide 10. A maximum diameter portion 2*c* is provided between the base end portion 2*a* and a forward end portion 2*b*. The dielectric rod 2 is gradually tapered from the maximum diameter portion 2*c* to the forward end portion 2*b*. A conductive film 4 is provided on an outer peripheral surface portion of the dielectric rod 2 which is inclined from the maximum diameter portion 2*c* toward the forward end portion 2*b*, in the form of a circular ring. This conductive film 4, which is made of Cu, Ag, Ag/Pd or the like, is preferably formed by a thin film forming method such as plating, vapor deposition or sputtering.

The waveguide 10, which is a conductor housing, is preferably in the form of a cylinder having open end portions 10*a* and 10*b*, so that an electromagnetic wave of the $TE_{11}$ mode is propagated through the interior of this waveguide 10. The base end portion 2*a* of the dielectric rod 2 is inserted in the opening 10*b* of the waveguide 10. On the other hand, a detection terminal (not shown) is arranged in the other opening 10*a* of the waveguide 10. The radome 12 of resin is mounted on this waveguide 10, in order to protect the dielectric rod 2 against rain, snow and the like.

In this dielectric rod antenna 1, the conductive film 4 which is provided on the outer peripheral surface of the dielectric rod 2 in the form of a ring intersects the waveguide 10 to form a substantially V-shaped cross-sectional area. The arrangement of the conductive film 4 and the waveguide 10 allows the conductive film 4 to uniformly suppress spreading of an electromagnetic wave which is propagated through the interior of the dielectric rod 2, thereby substantially equalizing directional patterns of electric and magnetic field planes with each other.

Figure 2:
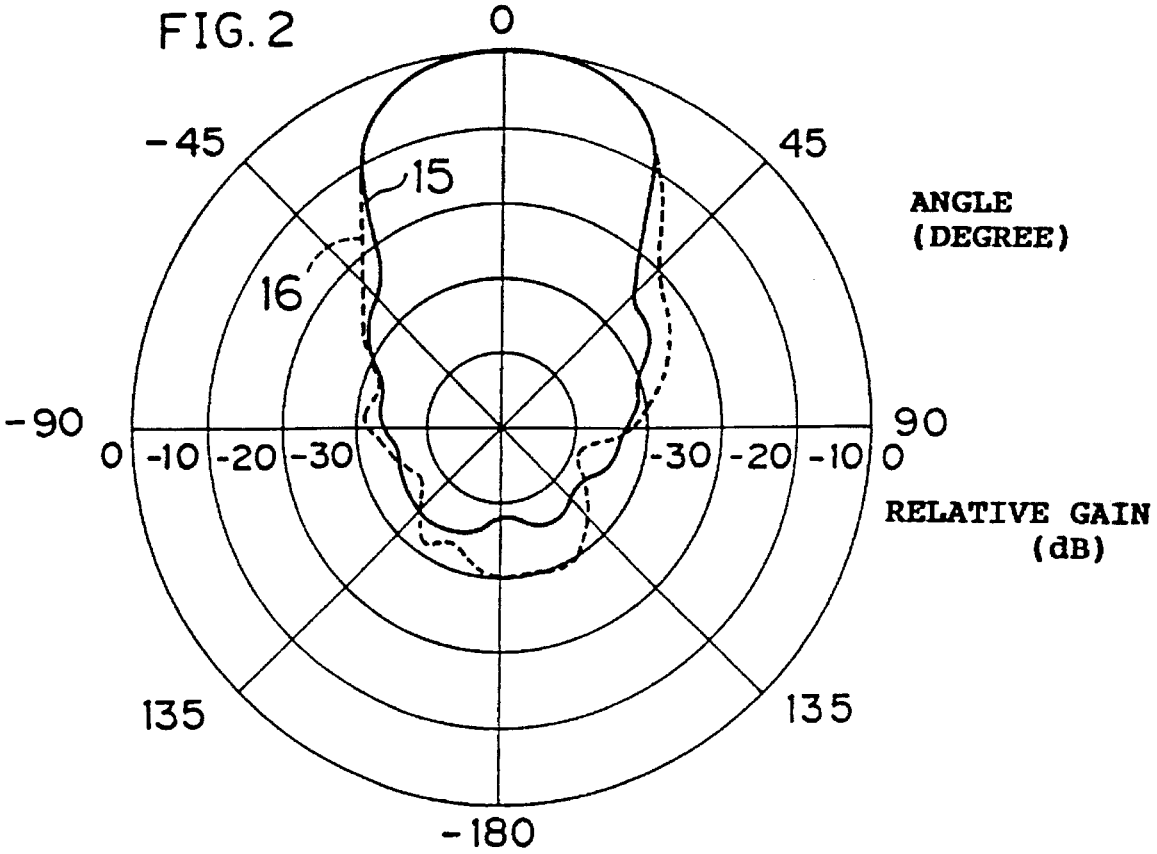
FIG. 2 is a graph showing a directional pattern of a magnetic field radiation pattern of the dielectric rod antenna shown in FIG. 1.
Figure 3:
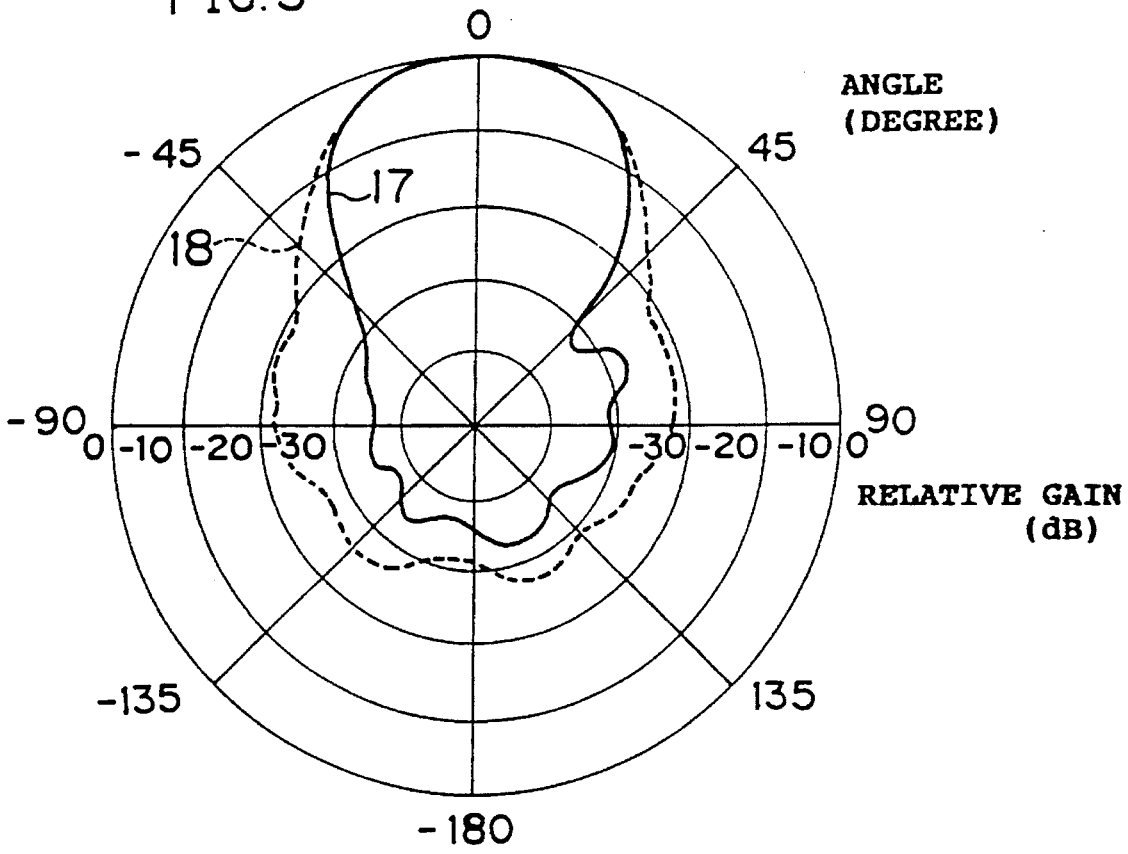
FIG. 3 is a graph showing a directional pattern of an electric field radiation pattern of the dielectric rod antenna shown in FIG. 1.

FIGS. 2 and 3 are graphs showing directional patterns of the dielectric rod antenna 1 measured as to the magnetic and electric field planes respectively (see solid lines 15 and 17). For the purpose of comparison, these figures also show directional patterns of a dielectric rod antenna which is provided with no conductive film (see dotted lines 16 and 18). In the dielectric rod antenna 1 provided with the conductive film 4, the directional pattern of the electric field plane is improved in particular. Namely, side lobes are reduced and angles for obtaining a voltage which is lower by 10 dB than a voltage received in the front direction are substantially equalized with each other in the magnetic and electric field planes.

When the dielectric rod antenna 1 is employed as a primary radiator for an offset parabolic reflector antenna, therefore, it is possible to obtain an antenna which causes small polarization loss also when a circularly polarized electromagnetic wave is received, since the directional patterns of the magnetic and electric field planes are substantially equal to each other.

Figure 4:
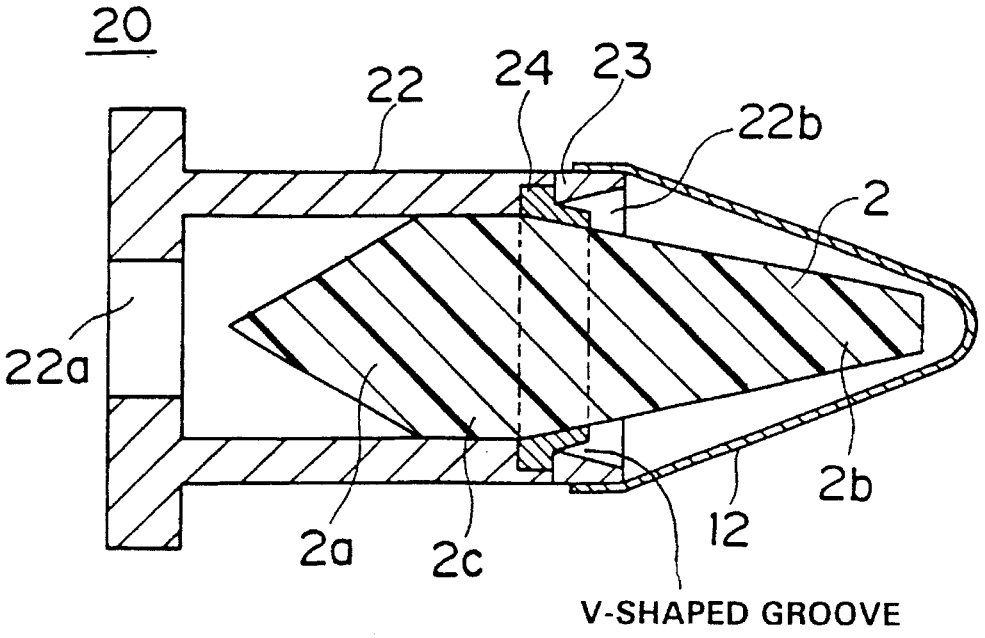
FIG. 4 is a sectional view showing a dielectric rod antenna according to a second preferred embodiment of the present invention.
Figure 5:
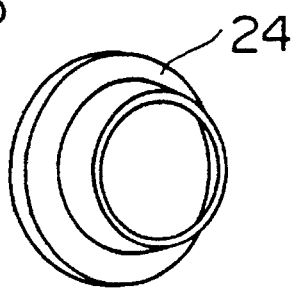
FIG. 5 is a perspective view showing a conductive member of the dielectric rod antenna shown in FIG. 4.

FIG. 4 shows a dielectric rod antenna 20 according to a second preferred embodiment of the present invention. As shown in FIG. 4, this dielectric rod antenna 20 is formed by a dielectric rod 2, a radome 12, a waveguide 22 and a conductive member 24. The waveguide 22, which is a conductor housing, is in the form of a cylinder having open end portions 22*a* and 22*b*. A base end portion 2*a* of the dielectric rod 2 is inserted in the opening 22*b* of the waveguide 22. The waveguide 22 and the dielectric rod 2 are fixed by the conductive member 24, being in the form of a circular ring as shown in FIG. 5, which is mounted on an outer peripheral surface portion of the dielectric rod 2 inclined from a maximum diameter portion 2*c* toward a forward end portion 2*b*. The ring-shaped conductive member 24 can be made of a metal such as Cu or Ag, or an alloy thereof, for example. In order to facilitate the aforementioned fixation, a ring-shaped fastening member 23 is fixed to an end surface of the opening 22*b* of the waveguide 22 by an adhesive. A detection terminal (not shown) is arranged in the other opening 22*a* of the waveguide 22.

The dielectric rod antenna 20 having the aforementioned structure has a function and an effect which are similar to those of the dielectric rod antenna 1 according to the first embodiment, due to the ring-shaped conductive member 24 which is mounted on the outer peripheral surface of the dielectric rod 2 so as to intersect the waveguide 22 to form a V-shaped cross-sectional area.

Figure 6:
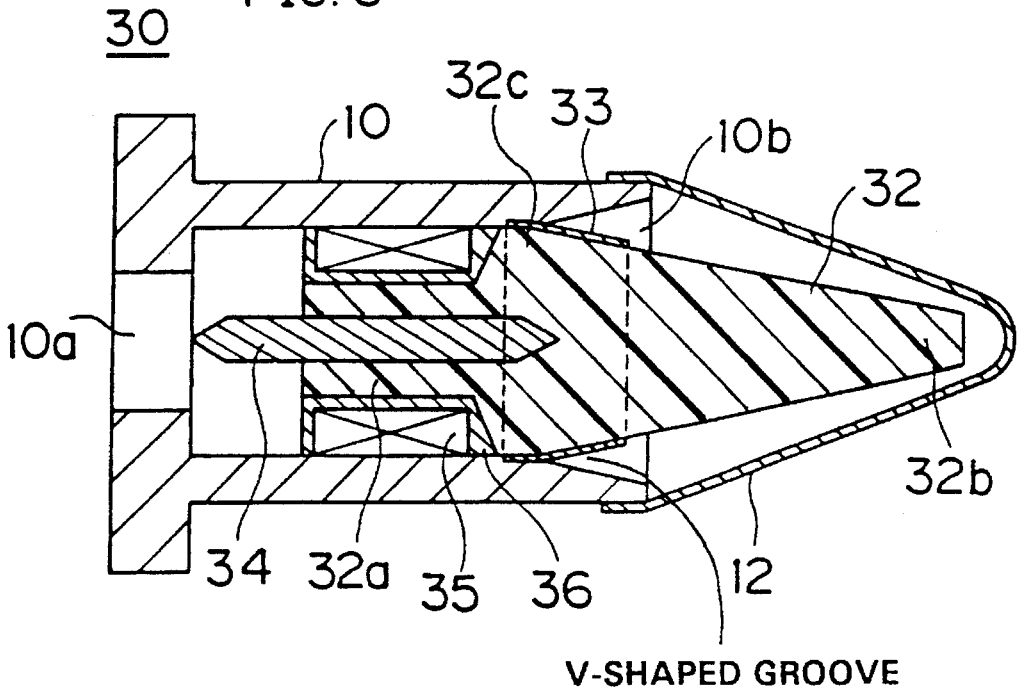
FIG. 6 is a sectional view showing a dielectric rod antenna according to a third preferred embodiment of the present invention.

FIG. 6 shows a dielectric rod antenna 30 provided with a polarization converter according to a third preferred embodiment of the present invention. This dielectric rod antenna 30 is formed by a dielectric rod 32, a waveguide 10, a radome 12, a long ferrite member 34, a solenoid 35, and a bobbin 36.

The dielectric rod 32 has a circular cross section. A base end portion 32*a* of the dielectric rod 32 is substantially in the form of a cylinder having a smaller diameter than a maximum diameter portion 32*c*, and the long ferrite member 34 is mounted on this cylindrical base end portion 32*a*. In other words, an end of the ferrite member 34 is embedded in the base end portion 32*a*, while another end is projected from the base end portion 32*a* toward an opening 10*a* of the waveguide 10.

The ferrite member 34 is made of YIG (yttrium iron garnet) or the like, and its axial direction is in parallel with that of the dielectric rod 32. The solenoid 35, consisting of a winding which is wound on a body portion of the substantially cylindrical bobbin 36, is fixed to the base end portion 32*a*. When the solenoid 35 is supplied with a current, a dc magnetic field is generated in the axial direction of the solenoid 35, i.e., in the axial direction of the ferrite member 34.

The dielectric rod 32 is gradually tapered from the maximum diameter portion 32*c* toward the forward end portion 32*b*, and a conductive film 33 is provided on an outer peripheral surface portion of the dielectric rod 32 which is inclined toward the forward portion 32*b*, in the form of a circular ring.

The dielectric rod antenna 30 having the aforementioned structure has a function and an effect which are similar to those of the dielectric rod antenna 1 according to the first embodiment, due to the ring-shaped conductive film 33 provided on a side surface of the dielectric rod 32 so as to intersect the waveguide 10 to form a substantially V-shaped cross-section area. An electromagnetic wave which is received by the dielectric rod 32 is propagated through the interior of the ferrite member 34, while a Faraday effect is caused in the ferrite member 34 by the dc magnetic field which is generated by the solenoid 35, to rotate the plane of polarization of the electromagnetic wave by a prescribed angle. Thus, it is possible to easily obtain the dielectric rod antenna 30 provided with a polarization converter.

Figure 7:
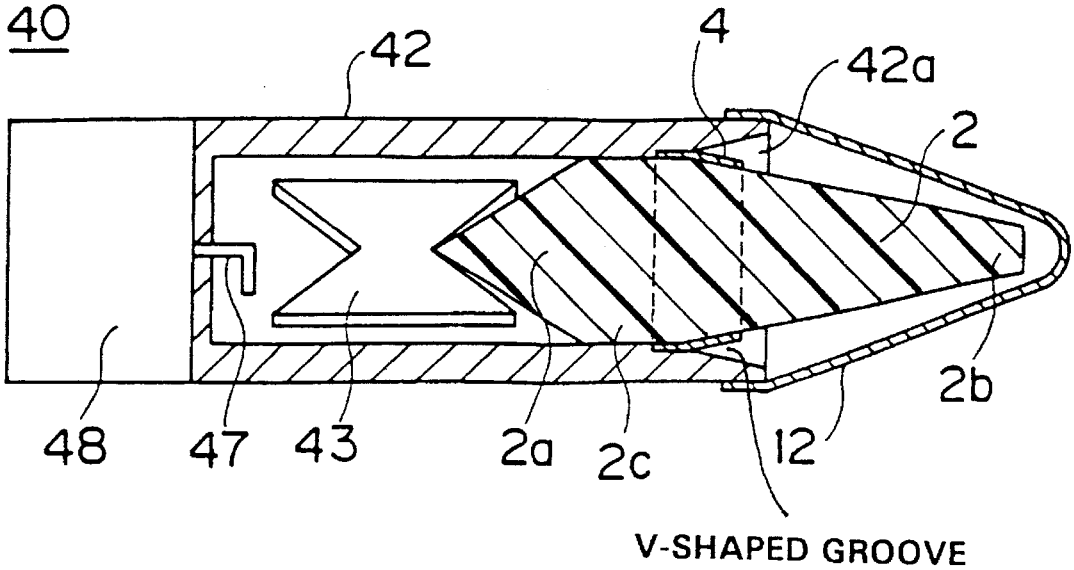
FIG. 7 is a partially fragmented sectional view showing a dielectric rod antenna according to a fourth preferred embodiment of the present invention.

FIG. 7 shows a dielectric rod antenna 40 provided with a circular polarization converter which is switchable between right-handed circular polarization and left-handed circular polarization according to a fourth preferred embodiment of the present invention. The dielectric rod antenna 40 is formed by a dielectric rod 2, a radome 12, a waveguide 42, a flat plate type polarization converter 43, a detection terminal 47, and a motor 48 for rotating/driving the detection terminal 47. The waveguide 42, which is a metal housing, is in the form of a cylinder, and a base end portion 2*a* of the dielectric rod 2 is inserted in an opening 42*a* which is provided in one end of the waveguide 42.

The flat plate type polarization converter 43 is fixed to the inner wall of the waveguide 42 in a state being close to a forward end of the base end portion 2*a* which is in the form of a conical protrusion. The detection terminal 47 which is coupled to a rotary shaft of the motor 48 is L-shaped, and rotated/driven by the motor 48. The rotary shaft of the motor 48 can be freely switched between rightward rotation and leftward rotation.

The dielectric rod antenna 40 having the aforementioned structure has a function and an effect which are similar to those of the dielectric rod antenna 1 according to the first embodiment, due to a conductive film 4 which is provided on an outer peripheral surface of the dielectric rod 2so as to intersect the waveguide 42 to form a substantially V-shaped cross-sectional area. Further, a circularly polarized electromagnetic wave received by the dielectric rod 2 is converted by the polarization converter 43 to that having a plane of polarization which is inclined clockwise by 45° C. with respect to the major surface of the polarization converter 43, if the same is right-handed. If the as-received electromagnetic wave is left-handed, on the other hand, the same is converted to that having a plane of polarization which is inclined anticlockwise by 45° with respect to the major surface of the polarization converter 43. Thus, the electromagnetic wave polarized to have a plane of polarization which is inclined clockwise by 45° with respect to major surface of the polarization converter 43 is detected by the rotated/driven detection terminal 47, which is set at this position. It is possible to detect an electromagnetic wave of right-handed or left-handed circular polarization by setting the position of the rotary shaft of the motor 48 in right or left rotation. Thus, it is possible to easily obtain the dielectric rod antenna 40 provided with a circular polarization converter.

Figure 8:
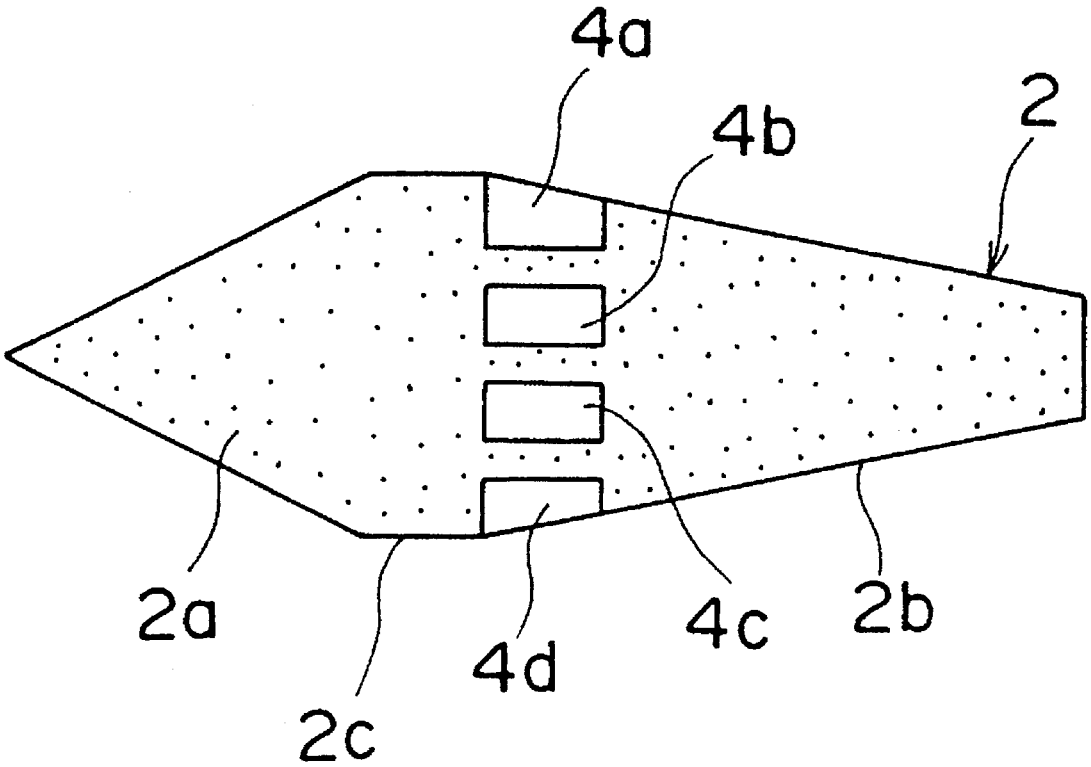
FIG. 8 is a sectional view showing a modification of a conductor which is mounted on an outer periphery of a dielectric rod.

The dielectric rod antenna according to the present invention is not restricted to the aforementioned preferred embodiments, but various modifications are available within the scope of the present invention. In particular, a conductor 4 provided on an outer peripheral surface of a dielectric rod 2 may be replaced by a plurality of conductor members 4*a*, 4*b*, 4*c* and 4*d* as shown in FIG. 8, so far as these members substantially define a ring as a whole. Such a conductor is provided in the form of a circular, elliptical or rectangular ring, in response to the shape of the dielectric rod.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dielectric rod antenna comprising:

a dielectric rod having a forward end portion and a base end portion being opposed to said forward end portion;

a conductor being provided on an outer peripheral surface of said dielectric rod substantially in the form of a ring; and a conductor housing being so provided as to support said dielectric rod;

wherein said conductor is arranged to intersect said conductor housing to define therebetween a substantially V-shaped cross-sectional area.

2. A dielectric rod antenna in accordance with claim 1, further comprising:

a long ferrite member being arranged with an axial direction thereof being in parallel with an axial direction of said dielectric rod, said long ferrite member having an end being embedded in said base end portion of said dielectric rod and another end being projected therefrom, and magnetic field generation means for generating a magnetic field in parallel with said axial direction of said ferrite member.

3. A dielectric rod antenna in accordance with claim 2, wherein said magnetic field generation means is a solenoid.

4. A dielectric rod antenna in accordance with claim 1, further comprising a flat plate type polarization converter being provided in series wit said base end portion of said dielectric rod, said flat plate type polarization converter being arranged so that a major surface thereof is in parallel with a longitudinal direction of said dielectric rod.

5. A dielectric rod antenna in accordance with claim 4, further comprising:

a detection terminal, being separated from said flat plate type polarization converter, provided on an opposite side of said base end portion of said dielectric rod through said polarization converter, and a rotation/driving source being coupled to said detection terminal for rotating/driving said detection terminal.

6. A dielectric rod antenna in accordance with claim 1, wherein said conductor is a conductive film being formed by a thin film forming method.

7. A dielectric rod antenna in accordance with claim 1, wherein said conductor consists of a conductive member being provided in the form of a ring.

8. A dielectric rod antenna in accordance with claim 1, wherein said conductor substantially in the form of a ring comprises a plurality of conductors being separated from each other at prescribed intervals for defining a ring.

* * * * *